US005767818A

United States Patent [19]

Nishida

[11] Patent Number: 5,767,818

[45] Date of Patent: Jun. 16, 1998

[54] DISPLAY DEVICE

[76] Inventor: Shinsuke Nishida, #504, Oyamadai Riverside Hidence, 23-14, Tamatsutsumi 1-chome, Setagaya-ku, Tokyo 158, Japan

[21] Appl. No.: 648,169

[22] PCT Filed: May 10, 1995

[86] PCT No.: PCT/JP95/00901

§ 371 Date: May 22, 1996

§ 102(e) Date: May 22, 1996

[87] PCT Pub. No.: WO96/10244

PCT Pub. Date: Apr. 4, 1996

[30] Foreign Application Priority Data

Sep. 27, 1994 [JP] Japan ..... 6-257618

[51] Int. Cl.[6] ..... G09G 3/20

[52] U.S. Cl. ..... 345/1; 345/55; 345/73; 345/212

[58] Field of Search ..... 345/30, 33, 55, 345/84, 98, 204, 211, 903, 73, 212; 348/383

[56] References Cited

U.S. PATENT DOCUMENTS

| | | | |
|---|---|---|---|
| 4,677,427 | 6/1987 | Komatsu et al. | 340/703 |
| 4,682,162 | 7/1987 | Holloman | 340/799 |
| 4,745,322 | 5/1988 | Terazaki . | |
| 4,833,542 | 5/1989 | Hara et al. | 358/230 |
| 4,901,155 | 2/1990 | Hara et al. | 358/230 |
| 5,247,376 | 9/1993 | Wakai | 359/55 |

FOREIGN PATENT DOCUMENTS

| | | |
|---|---|---|
| 61-41188 | 2/1986 | Japan . |
| 61-223878 | 10/1986 | Japan . |
| 1-116585 | 5/1989 | Japan . |
| 2-264995 | 10/1990 | Japan . |

*Primary Examiner*—Steven J. Saras
*Assistant Examiner*—Vincent E. Kovalick
*Attorney, Agent, or Firm*—Ladas & Parry

[57] ABSTRACT

A display device which includes a simplified wiring for respective display elements is provided to facilitate the assembly and maintenance. The display device is constituted of a large number of display units (50) arranged in a matrix, each including a display element (10) composed of a light bulb, a regulator (51) composed of a relay, an nonvolatile memory (52) composed of an EEPROM, and a controller (53) composed of a CPU. A common electric power transmission line (61) and a common signal transmission line (71) are wired for the plural display units (50). A display signal including address information and data information is supplied to the signal transmission line (71). Each controller (53) controls an associated regulator (51) to light on/off an associated display element (10), based on the data information in the display signal only when the address stored in the nonvolatile memory (52) agrees with the address information in the display signal.

6 Claims, 9 Drawing Sheets

DISPLAY SIGNAL

DISPLAY DEVICE

FIELD OF THE INVENTION

The present invention relates to a display device, especially a type of display which is attached on a wall, such as an electric bulletin board, an advertisement sign board or the like.

BACKGROUND ART

Wall display devices, such as electric bulletin boards and advertisement sign boards, are widely used as means for providing information to many and unspecific people on streets. Such a wall display device usually includes a number of display elements arranged on a plane in which an individual element is used for one pixel. The respective display elements are electrically actuated in various manner to display information. In an electric bulletin board, for example, one light bulb is used as one display element for one pixel, and a plurality of the light bulbs are arranged in matrix. By illuminating those of the light bulbs in specified positions, it is possible to display letters and pictures. Recently electric bulletin boards using light emitting diodes in place of the light bulbs are widely used.

An advertisement sign board uses "panel display elements" as display elements constituting respective pixels. The "panel display elements" are not light emitting themselves but have a plurality of display faces only one of which is actually displayed. Usually one of the display faces to be displayed can be selected by using a rotary mechanism, such as a motor or the like. One display face is selected for each pixel, whereby letters or pictures can be displayed.

The display elements for respective pixels, which are thus provided by light bulbs, light emitting diodes, panel display elements or the like, are electrically actuated. The light bulbs and the light emitting diodes, for example, can be switched between their light emitting state and non-light emitting state by On/Off control of electric power supply. By conducting the On/Off control on the respective light bulbs or the respective light emitting diodes providing the respective pixels, only required pixels can be selectively illuminated, whereby required information can be displayed. In the panel display elements the On/Off control of electric power supply to the motor is conducted, whereby those of the display faces to be actually displayed can be selected. The On/Off control is conducted on the respective panel display elements providing the respective pixels, whereby a required display face for each pixel can be displayed and required information can be displayed.

In the above-described display devices, needless to say, larger numbers of pixels are necessary for improvement of their display resolution. Accordingly it is necessary that a large number of display elements for respective pixels are arranged in a matrix. As described above, since display manners of the respective display elements must be controlled by electric power supply, it is needed to provide an individual electric power supply line for the individual display elements. In an electric bulletin board having 100 light bulbs arranged in a matrix, for example, two electric power supply lines are needed for each of the 100 light bulbs, and therefore totally 200 lines must be wired from a switchboard to the light bulbs. For high resolution a lager number of light bulbs must be arranged, which increases a number of wiring lines. When a number of wiring lines becomes increased, a structure of a display device becomes complicated, which need much labor for its manufacture and maintenance. This results in higher manufacturing costs and maintenance costs.

SUMMARY OF THE INVENTION

An object of the present invention is to provide a display device which can simplify wiring for respective display elements, and facilitates manufacturing and maintenance of the device.

A first feature of the invention resides in a display device including an array of display elements to display information, each of the display elements having a function to electrically change display modes of a pixel, characterized in that the display device comprises:

a plurality of display units, each of the display units including a display element, a regulator for controlling supply of electric power to the display element, memory means for storing prescribed address information, and a controller for controlling the regulator based on the address information stored in the memory means and a display signal supplied from an outside of the display units;

a casing for fixedly accommodating the display units with the display elements arranged adjacent to each other on a display screen;

an electric power source for generating electric power for driving the display elements;

a control device for generating the display signal indicating a display mode of the display elements;

electric power transmission means for supplying the electric power generated by the electric power source to the regulators in the respective display units accommodated in the device casing; and signal transmission means for supplying the display signal generated by the control device to the controllers in the respective display units, wherein respective unique address information is stored in the respective memory means of the display units and the display signal contains address information for indicating a specific display unit and data information for indicating a specific display mode; and wherein the controller controls the regulator based on the data information in the display signal when the address information stored in the memory means corresponds to the address information contained in the display signal.

A second feature of the invention resides in a display device according to the first feature:

wherein a plurality of display elements are provided in each display unit;

wherein the address information contained in the display signal includes a first address information indicative of a specific display unit and a second address information indicative of a specific display element in a display unit; and wherein the controller controls a regulator for a specific display element indicated by the second address information based on the data information in the display signal when the address information stored in the memory means corresponds to the first address information.

A third feature of the invention resides in a display device according to the first or second feature:

wherein each display element includes a first color presenting element for presenting a first primary color R by energizing, a second color presenting element for presenting a second primary color G by energizing, and a third color presenting element for presenting a third primary color B by energizing;

wherein the data information in the display signal includes information instructing light emitting states of the respective color presenting elements; and wherein the controller controls the regulator to supply electric power in accordance with the instructing information.

A fourth feature of the invention resides in a display device according to the above-described features:

wherein each display unit includes a container;

wherein a display surface is formed by the display element on a top surface of the container, and electrodes functioning as a part of the electric power transmission means and the signal transmission means are formed on side surfaces of the container; and wherein a plurality of display units are accommodated in the casing so that electrodes formed on the display units are physically in contact with adjacent ones, transmission lines of the electric power transmission means and the signal transmission means being constituted by physical contact between the electrodes.

A fifth feature of the invention resides in a display device according to the above-described features, the device further comprising:

an address setting line for serially connecting a plurality of controllers in all the display units or a part of the display units;

wherein the respective controller has a function of address setting in which when a prescribed address information is supplied to an input side of the address setting line, the address information is stored in the memory means, and the address information is renewed and outputted to an output side of the address setting line.

A sixth feature of the invention resides in a display device according to the fifth feature:

wherein a common transmission line which functions as both the signal transmission means and the address setting line; and wherein the common transmission line is switched so that when the common transmission line functions as the signal transmission means, branches of the common transmission line connect to the respective controllers, and when the common transmission line functions as the address setting line, the common transmission line provides a serial connecting line to serially connect the respective controllers.

A display device according to the present invention is constituted by a plurality of display units arranged in a casing. Each display unit comprises at least one display element (which functions as a pixel of display), a regulator for controlling electric power supply to the display element, memory means, and a controller. When the display element is composed of, for example, a light bulb and the regulator is composed of a relay provided on a power supplying line for the light bulb, the controller can control an on/off state of the light bulb by operating the relay. An instruction to the controller is given from a control device as a form of a display signal.

The characterized feature of the display device according to the present invention is that a common electric power transmission passage and a common signal transmission passage are used for all the display units. In the conventional electric bulletin board, as described above, wiring becomes very complicated because individual power transmission lines are needed for the respective light bulbs. In an electric bulletin board of the invention, electric power is always supplied toward all the light bulbs by using a common power transmission passage. Though electric power is always supplied toward all the light bulbs, it is possible to independently switch on/off state of the respective light bulbs by an operation of the controller.

In each display unit, there is provided memory means in which unique address information for every respective display unit is stored. For example, when "address 1" to "address 10" are stored in memory means of ten display units, respectively, each controller of the respective display units can recognize its own address by accessing respective memory means. Therefore, by preparing a display signal which consists of address information indicative of a specific display unit and data information indicative of a specific display mode, even if this display signal is supplied to all the display units through a common signal transmission passage, it is possible to make only the specific display unit having a corresponding address execute an operation instructed by the data information. For example, when a display signal consisting of address information of "address 3" and data information of "light on" is supplied to all the ten display units, only the third display unit in which "address 3" is stored in memory means executes the operation of turning on the light bulb.

In short, according to the display device of the present invention, since each display unit has an intelligent function, even if a common electric power transmission passage is used for supplying power to all the display units and a common signal transmission passage is used for supplying a same display signal to all the display units, it is possible to make the display units independently operate. By using a common electric power transmission passage and a common signal transmission passage, a number of required wiring lines becomes constant even if a number of display units is caused to be increased, so that wiring becomes simplified.

Further, if an address setting line which serially connects a plurality of controllers is provided so that prescribed address information can be delivered to the respective controllers through the address setting line and the address information is sequentially renewed every time when it passes through each controller, it becomes possible to efficiently carry out the address setting procedure to write unique addresses in memory means of the respective display units. In addition, if the signal transmission line to transmit a display signal is commonly used as the address setting line, it becomes needless to newly provide an additional line for carrying out the address setting procedure.

BEST MODE FOR CARRYING OUT THE INVENTION

§0. Conventional Electric Bulletin Board

Figure 1:
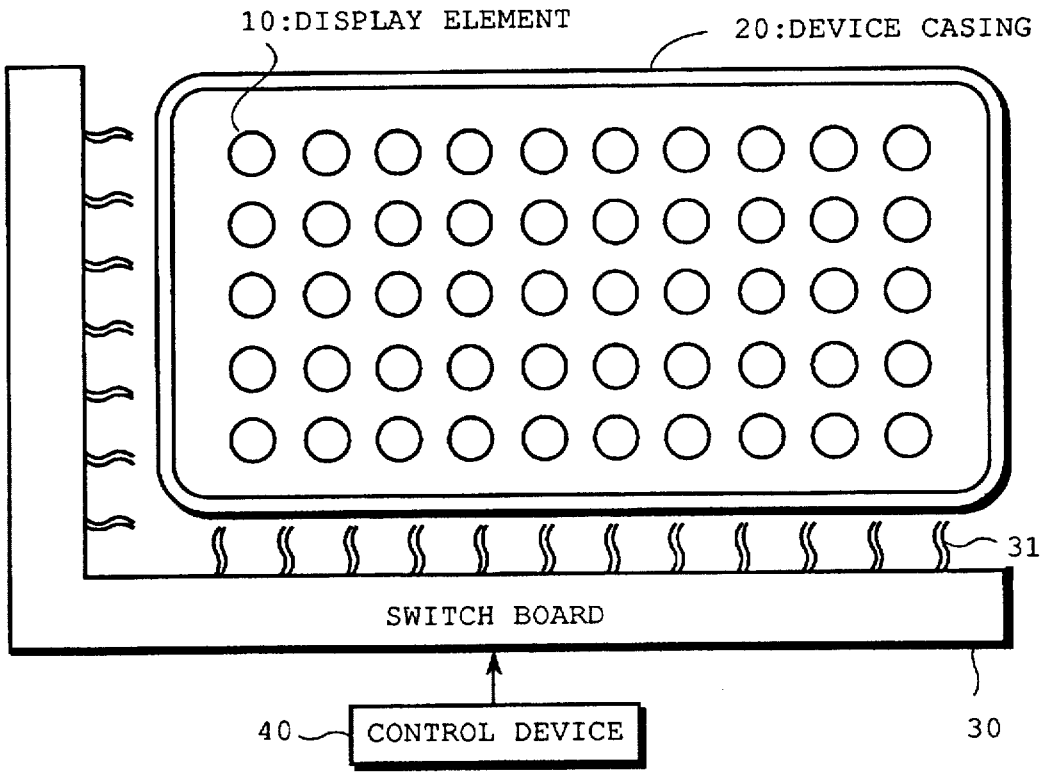
FIG. 1 is a structural view showing a structure of a conventional general electric bulletin board.

The present invention will be described based on an embodiment shown in drawings attached hereto. First, for comparison of the conventional electric bulletin board with the present invention, the structure of the conventional, general electric bulletin board will be described with reference to FIG. 1. In the conventional electric bulletin board, respective display elements 10 are provided by light bulbs. In this example, display elements 10 are arranged in a 5-by-10 matrix and housed in a device casing 20. A switchboard 30 is provided for supplying electric power to these fifty display elements (light bulbs) 10, and control device 40 is provided for giving commands to the switchboard 30. Two electric power supply lines 31 are wired to each of the display elements 10 (only a part of the wiring is shown to simplify the drawing). The control device 40 gives to the switchboard 30 commands as to which display elements 10 are to be electrically activated, based on information to be displayed (e.g., letters) on this electric bulletin board. Based on the commands, the switchboard 30 supplies electric power to only those of the electric power supply lines 31 associated with the required display elements 10. Only required display elements 10 are thus lit, and information is displayed by using the respective display elements 10 as individual pixels.

As described above, such a conventional electric bulletin board, however, has the problem that the wiring is very complicated. In the example of FIG. 1, two electric power supply lines are necessary for each of the fifty display elements 10, and therefore totally a hundred electric power supply lines have to be wired. In practical purposes, high resolutions are necessary to display complicated letters and pictures, which needs more display elements 10 so that the wiring becomes more complicated.

The present invention is to provide a technical idea which can avoid such complicated wiring.

§1. First Embodiment of the Present Invention

Figure 2:
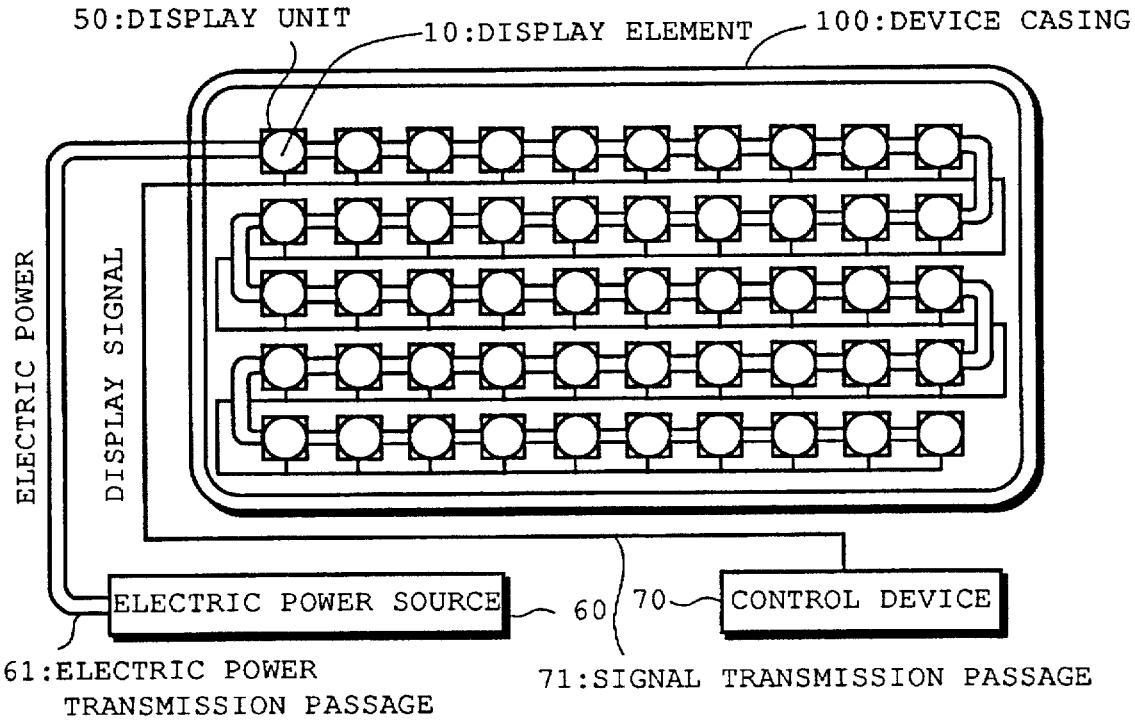
FIG. 2 is a structural view showing a structure of a display device according to a first embodiment of the present invention.

FIG. 2 is a view of a first embodiment in which the present invention is applied to the above-described electric bulletin board. In the electric bulletin board according to the present embodiment, each display element (light bulb) 10 is housed in a display unit 50, respectively. The respective display units 50 are arranged in a 5-by-10 matrix as in the electric bulletin board of FIG. 1 and housed fixedly in a casing 100. An electric power source 60 is provided for generating electric power to be supplied to the respective display units 50. Electric power generated by the electric power source 60 is supplied to the respective display units 50 through an electric power transmission passage 61. Control device 70 is provided for generating display signals to be supplied to the respective display units 50. Display signals generated by the control device 70 are transmitted to the respective display units 50 through a signal transmission passage 71.

What should be noted here is that the electric power transmission passage 61 and the signal transmission passage 71 are respectively common to the respective display units 50. In other words, the electric power transmission passage 61 and the signal transmission passage 71 are respectively single transmission passages which sequentially pass to a first display unit 50, a second display unit 50, a third display unit 50, . . . . a forty-ninth display unit 50 and a fiftieth display unit 50. To be more specific, two lines as the electric power transmission passage 61, and one line as the signal transmission passage 71, totally three lines are wired in the casing 100, and the wiring is completed. Thus, in comparison with the conventional electric bulletin board of FIG. 1, the wiring is much simplified, and furthermore the three wiring can still accommodate increased numbers of the display unit 50 for higher resolutions.

Figure 3:
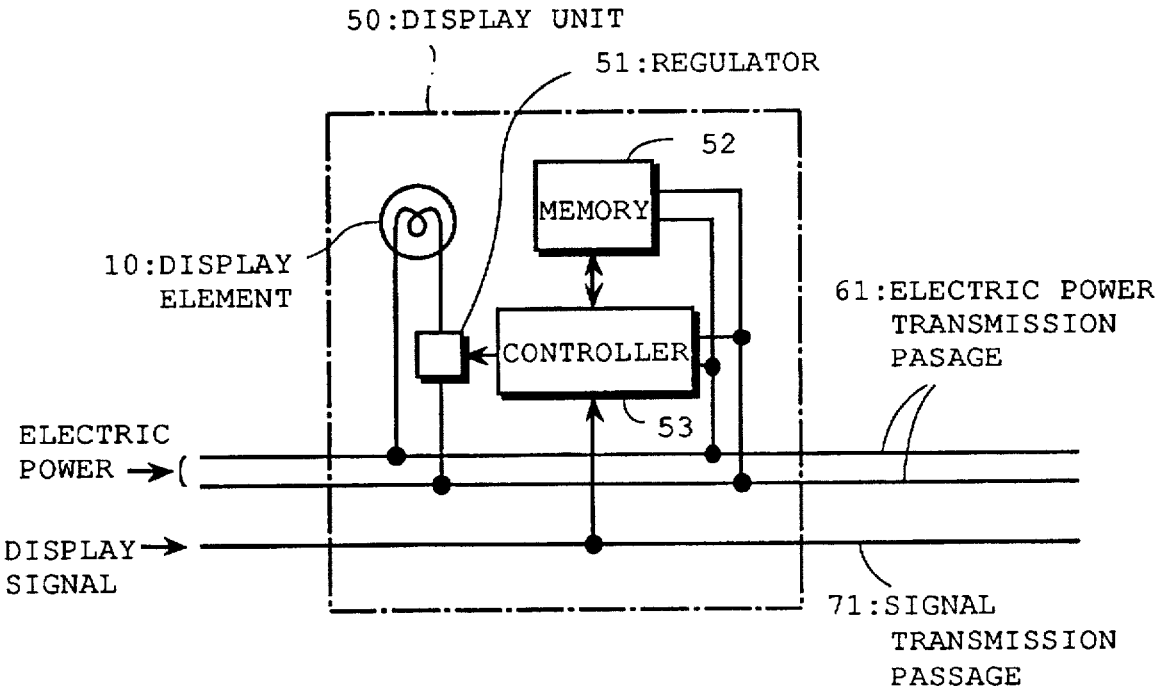
FIG. 3 is a circuit diagram of each display unit 50 used in the electric bulletin board shown in FIG. 2.

In the above-described embodiment, the electric power and the display signals are transmitted through the electric power transmission passage 61 and the signal transmission passage 71, which are common to the respective display units 50. Therefore, in order to make the respective display units 50 individually operate, components other than the display elements 10 are necessary in the respective display units 50. FIG. 3 shows a circuit diagram of a display unit 50 as an example. A light bulb as a display element 10 is connected to the electric power transmission passage 61 which is wired in the device casing. Electric power is supplied to the light bulb through the electric power transmission passage 61. One of the terminals of the light bulb is connected to the electric power transmission passage 61 through a regulator 51. Supply of the electric power to the display element 10 can be controlled by the regulator 51. Specifically the regulator 51 is provided by a relay and can control on/off of the electric power supply to the display element 10 (light bulb). In the display unit 50, there are further provided a nonvolatile memory 52 and a controller 53. Address information assigned for the display unit 50 has been stored in the nonvolatile memory 52. The controller 53 controls the regulator 51, based on the address information stored in the nonvolatile memory 52 and the display signals supplied by the control device 70 through the signal transmission passage 71. Electric power is supplied to the nonvolatile memory 52 and the controller 53 through the electric power transmission passage 61, and voltages necessary for their operations are secured.

Though the circuit diagram for one of the display units 50 is shown in FIG. 3, the rest of forty-nine display units 50 have completely the same structure in hardware as that of FIG. 3. However, address information stored in the associated nonvolatile memories of the respective display units 50 are different from each other. To facilitate the explanation of an operation of the display units 50, it is assumed here that the x-th display unit 50 has address information "address X" stored in the associated nonvolatile memory 52. For example, address information "Address 1" is stored in the nonvolatile memory 52 in the first display unit 50, and the address information "Address 50" is stored in the nonvolatile memory 52 in the fiftieth display unit 50.

Here a display signal to be transmitted through the signal transmission passage 71 includes address information indicative of a specific display unit 50 and data information indicative of a specific display mode. For example, a particular display signal such as "address information: Address 3, data information: Light on" is generated in the control device 70 and transmitted to all of the fifty display units 50 through the signal transmission passage 71. The controller 53 is programmed to be operative to control the regulator 51 based on data information of a display signal only when address information of the display signal agrees with address information stored in the nonvolatile memory 52 of the display unit 50. This arrangement enables the control operation that even when the above-described particular display signal is transmitted to all the display units 50, only the controller 53 in the third display unit 50 controls the regulator 51 to effect the control operation "Light the bulb" to be conducted, because only the nonvolatile memory 52 in the third display unit 50 contains the address information "Address 3". Although the same display signal has been transmitted to the rest of forty-nine display units 50, the controllers 53 of the rest do not operate to control the associated regulators 51. Thus such a control is enabled that only the display element 10 of the third display unit 50 is lit.

Figure 4:
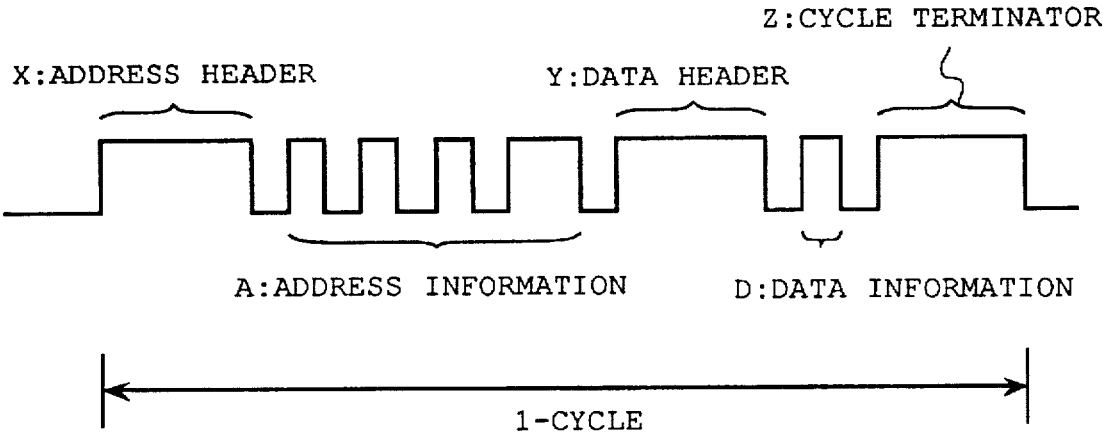
FIG. 4 is a signal diagram showing an example of a display signal which is used to operate the electric bulletin board shown in FIG. 2.
Figure 5:
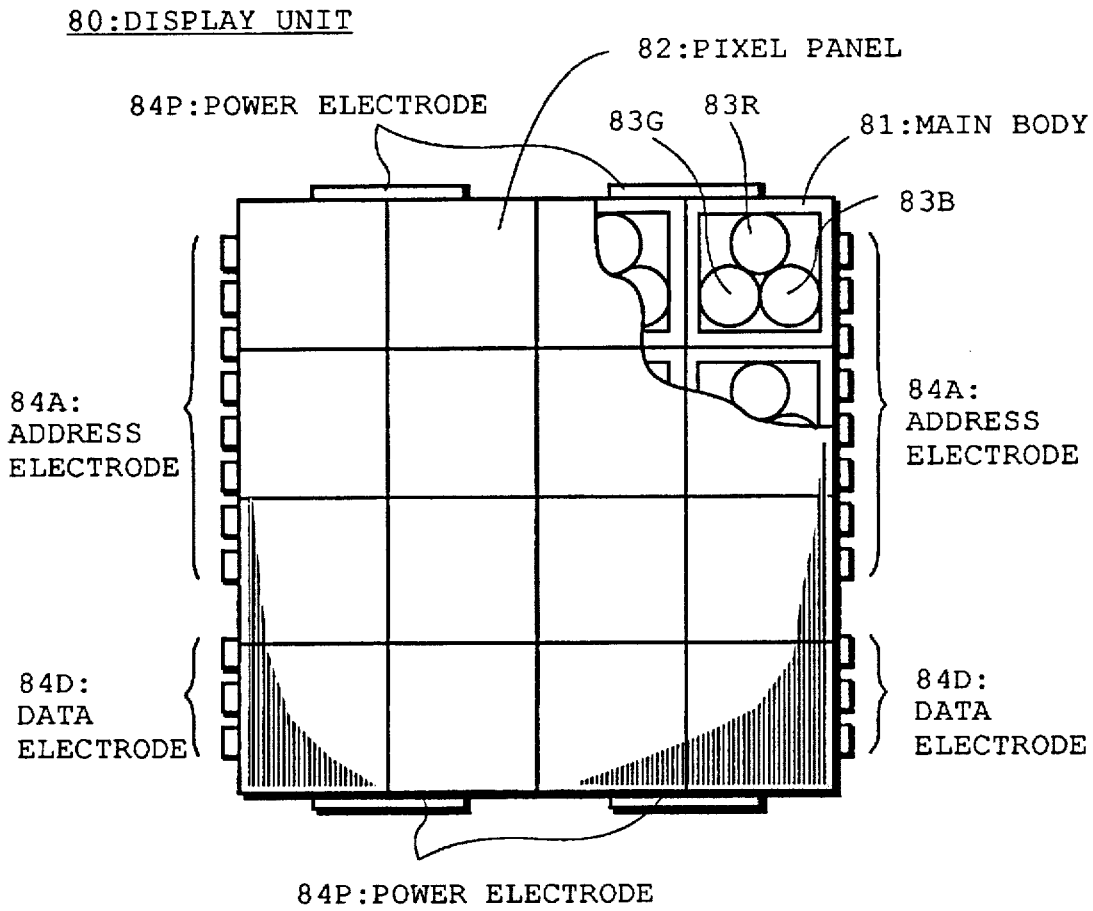
FIG. 5 is a top view of each display unit 80 used in a display device according to a second embodiment of the present invention.
Figure 6:
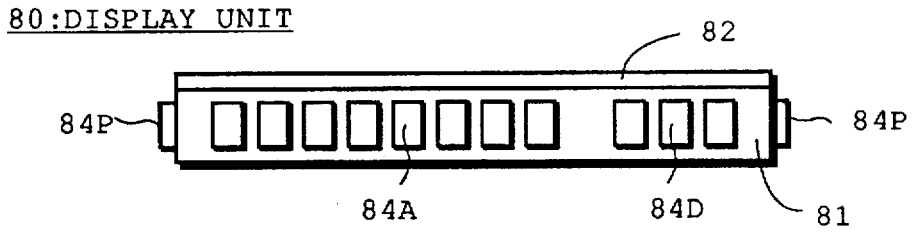
FIG. 6 is a left side view of the display unit 80 shown in FIG. 5.
Figure 7:
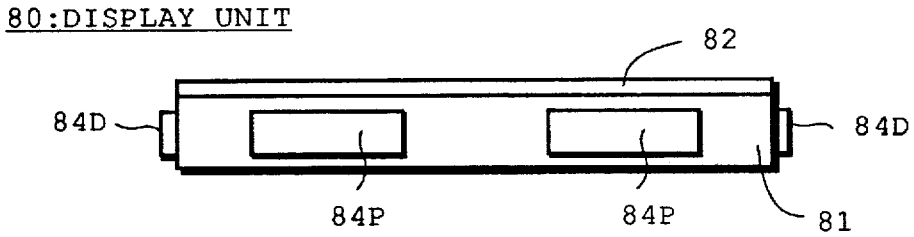
FIG. 7 is a front view of the display unit 80 shown in FIG. 5.

The display signal to be transmitted through the signal transmission passage 71 has a format exemplified in FIG. 4. The display signal of FIG. 4 is a digital signal having a binary condition of a high and a low levels. A period of one cycle shown here includes commands for one specific display unit 50. An address header X indicates that address information A will follow thereafter and a data header Y indicates that data information D will follow thereafter. A cycle terminator Z is indicative of the end of one cycle. Though the headers X, Y and the terminator Z are signals taking a constant high level for a whole period of time in the present embodiment of FIG. 4, practically it is preferred that the respective X, Y, Z are constituted of specific bit information so that the controllers 53 can easily recognize the respective headers and the terminator. In the present embodiment, the address information A is constituted of 8-bit digital information and indicates "Addresses 1" to "Addresses 50", and the data information D is constituted of 1-bit digital information wherein the high level "1" indicates the "Light on" display mode and the low level "0" indicating the "Light off" display mode.

When each controller 53 receives the display signal exemplified in FIG. 4, the controller 53 compares address information A of the display signal with address information stored in the associated volatile memory 52. When both address information disagree with each other, the controller 53 does not operate. When both address information agree with each other, the controller 53 effects the control operation to the associated regulator 51, based on data information D of the display signal. That is, when the data information D is high level "1", the regulator (relay) 51 is controlled to pass electric power to light the associated display element 10. When the data information D is low level "0", the regulator 51 is controlled not to pass electric power to light off the associated display element 10.

Thus a display mode of a specific display unit 50 can be controlled, based on one cycle of the display signal. By continuously transmitting fifty cycles of the display signal, commands of required display modes to all the fifty display units 50 can be controlled. Furthermore, by keeping the continuous transmission of fifty cycles of the display signal, display modes of the respective display units 50 can be transiently changed so that letters and pictures to be display can be transiently changed.

As described above, the respective display units 50 are completely the same in hardware, and can be mass-produced. When the nonvolatile memories 52 and the controllers 53 are provided by using EEPROMs and CPUs with a clock generator, it is possible to mass-produce a display unit 50 having a very simple structure, as the nonvolatile memories 52 and the controllers 53 can be fabricated on one chip. Finally the mass-produced display units 50 are arranged in the casing 100, and different address information is stored in the nonvolatile memories 52 of the respective display units 50 by using the associated controllers 53. Thus, the electric bulletin board according to the present invention can be completed. This fabrication drastically simplifies the wiring, which facilitates the fabrication and maintenance.

§2. Second Embodiment of the Present Invention

Next, a second embodiment of the present invention, in which the present invention is applied to a display device using light emitting diodes, is explained. FIGS. 5, 6, 7 and 8 are respectively the top view (partially broken), the left side view, the front view and the bottom view of an individual display unit 80 used in the second embodiment. Each display unit 80 includes a main body 81 in a form of a container having a square top surface. A pixel panel 82 are mounted on the top of a main body 81. The interior of the main body 81 is divided into totally sixteen sections of a 4-by-4 arrangement. Dividing lines corresponding to these sections are drawn on the pixel panel 82. One section corresponds to one pixel. Three light-emitting diodes 83R, 83G, 83B are arranged in each section in the main body 81. When electrically activated, the three light-emitting diodes 83R, 83G, 83B present a first primary color R (red), a second primary color G (green) and a third primary color B (blue). The pixel panel 82 is made of a material (e.g., glass) which transmits light from the light-emitting diodes 83R, 83G, 83B. When the display units 80 is seen from the above, specific colors are observed on respective pixels.

In the above-described first embodiment, one display unit 50 corresponds to one pixel, and one pixel is provided by one display element 10 (one light bulb). In the second embodiment, one display unit 80 corresponds to sixteen pixels, and one pixel is provided by three display elements (three light-emitting diodes 83R, 83G, 83B).

Another characteristic of the display unit 80 is that various kinds of electrodes are formed on the sides thereof. That is, as shown in the top view of FIG. 5, eight address electrodes 84A and three data electrodes 84D are provided on each of the left and right side surfaces. Two power electrodes 84P are provided on each of the front and the back surfaces. The arrangement and shapes of these electrodes are clearly shown in the left side view of FIG. 6 and the front view of FIG. 7. In the top view of FIG. 5, the eight address electrodes 84A on the left side surface and the eight address electrodes 84A on the right side surface are electrically connected with each other inside the main body 81. Similarly the three data electrodes 84D on the left side surface and the three data electrodes 84D on the right side surface are connected with each other inside the main body 81. The two power electrodes 84P on the front surface and the two power electrodes 84P on the back surface are also electrically connected to each other inside the main body 81.

Figure 8:
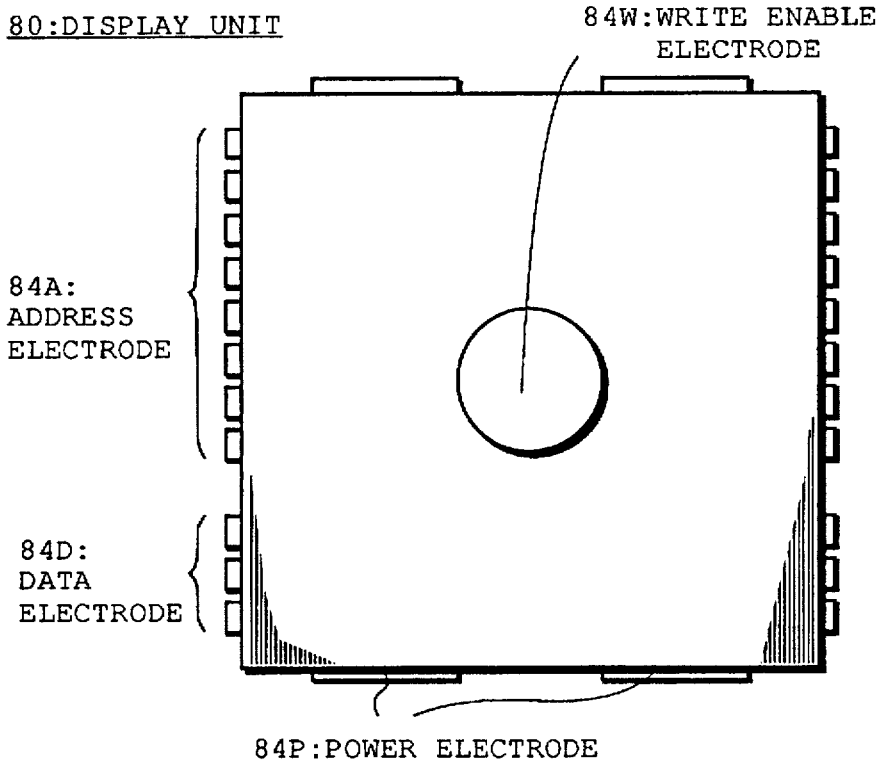
FIG. 8 is a bottom view of the display unit 80 shown in FIG. 5.

As shown in the bottom view of FIG. 8, a write enable electrode 84W is further provided on the bottom of the display unit 80. This write enable electrode 84W is used for applying a writing voltage which is required to write digital data to an nonvolatile memory built in the display unit when address information is to be set or written into the nonvolatile memory. The work for writing address information is conducted in a manufacturing process of this display device, and therefore the write enable electrode 84W is not used in practical use of the device.

Figure 9:
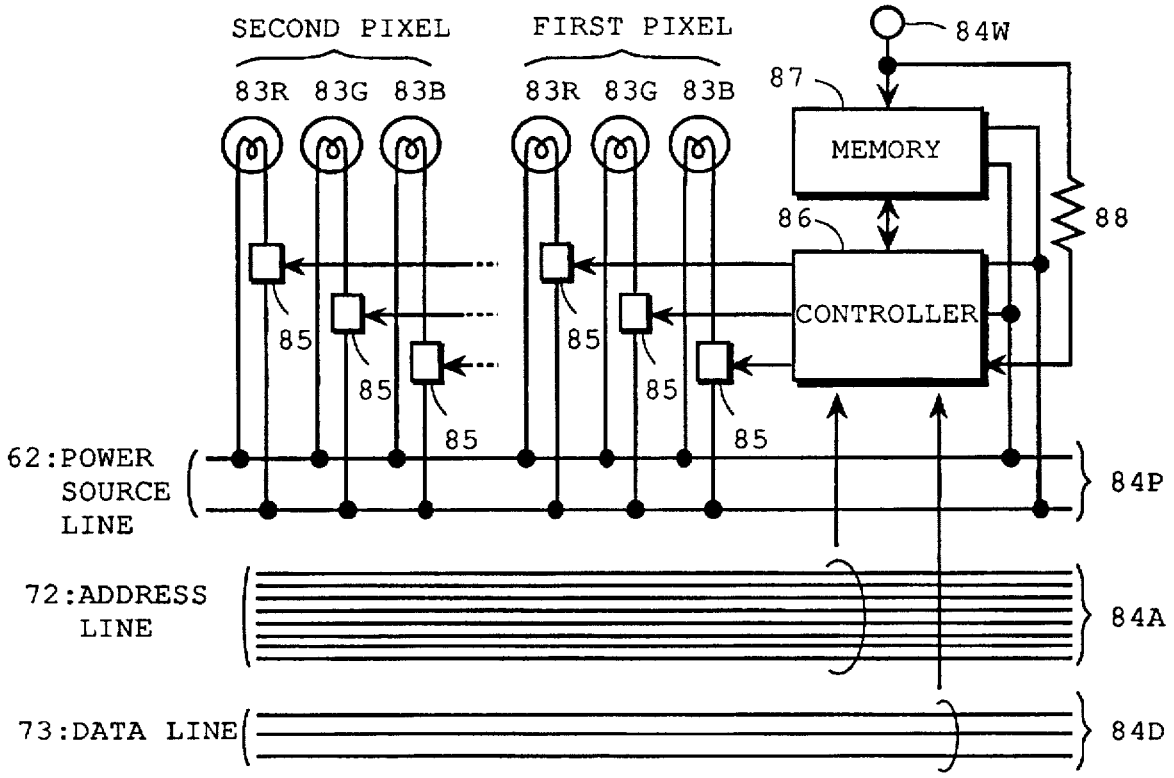
FIG. 9 is a circuit diagram of the display unit 80 shown in FIG. 5.

FIG. 9 is a wiring diagram inside the display unit 80. As shown in this wiring diagram, two power source lines 62 connected to the power electrode 84P, eight address lines 72 connected to the address electrodes 84A, and three data lines 73 connected to the data electrodes 84D are wired inside the display unit 80. As described above, the interior of the display unit 80 is divided into sixteen sections to provide sixteen pixels. Each pixel is constituted of three light-emitting diodes 83R, 83G, 83B (in FIG. 9, for convenience, only six light-emitting diodes belonging to a first pixel and to a second pixel are shown, but actually each of all the forty-eight (3×16=48) light emitting diodes has such wiring). The respective light-emitting diodes 83R, 83G, 83B are connected to the power source lines 62, wherein the respective one terminals are connected through their associated regulators (relays) 85. Operations of the respective regulators 85 are controlled by a controller 86. Address information A and data information D are supplied to the controller 86 respectively through address lines 72 and data lines 73. Based on these information supplied and address information stored in the nonvolatile memory 87, the controller 86 controls the individual regulators 85. A writing voltage can be applied to the nonvolatile memory 87 from the write enable electrode 84W, and required address information can be stored from the controller 86 into the nonvolatile memory 87. A writing voltage applied to the write enable electrode 84W is lowered by a resistance element 88 and the lowered voltage is to be supplied to a control terminal of the controller 86. The controller 86 is programmed so as to execute required writing operation into the nonvolatile memory 87 when the lowered voltage is supplied to the control terminal. Electric power is supplied to the controller 86 and the nonvolatile memory 87 through the power lines 62, so that a voltage necessary for the operation can be secured.

Figure 10:
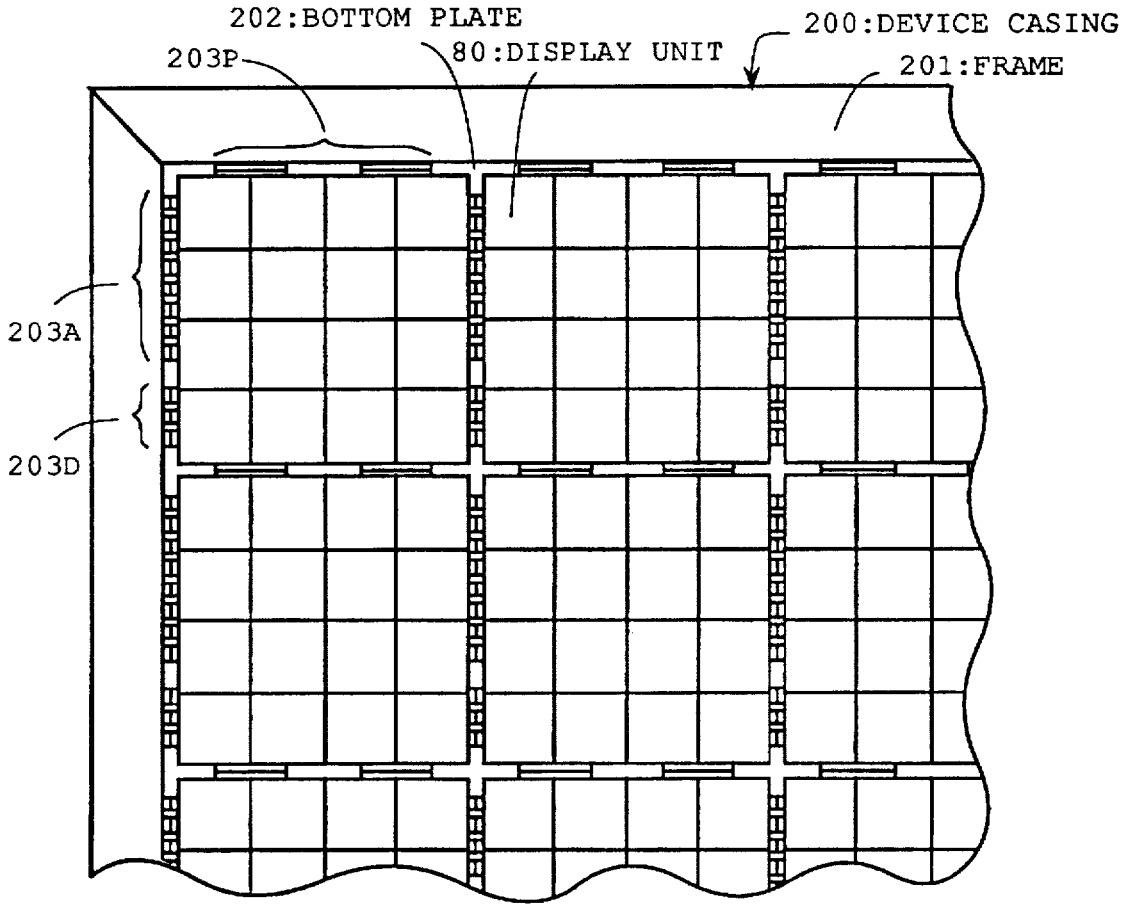
FIG. 10 is a partial top view showing a display wherein a plurality of the display unit 80 shown in FIG. 5 are accommodated in a device casing 200.
Figure 11:
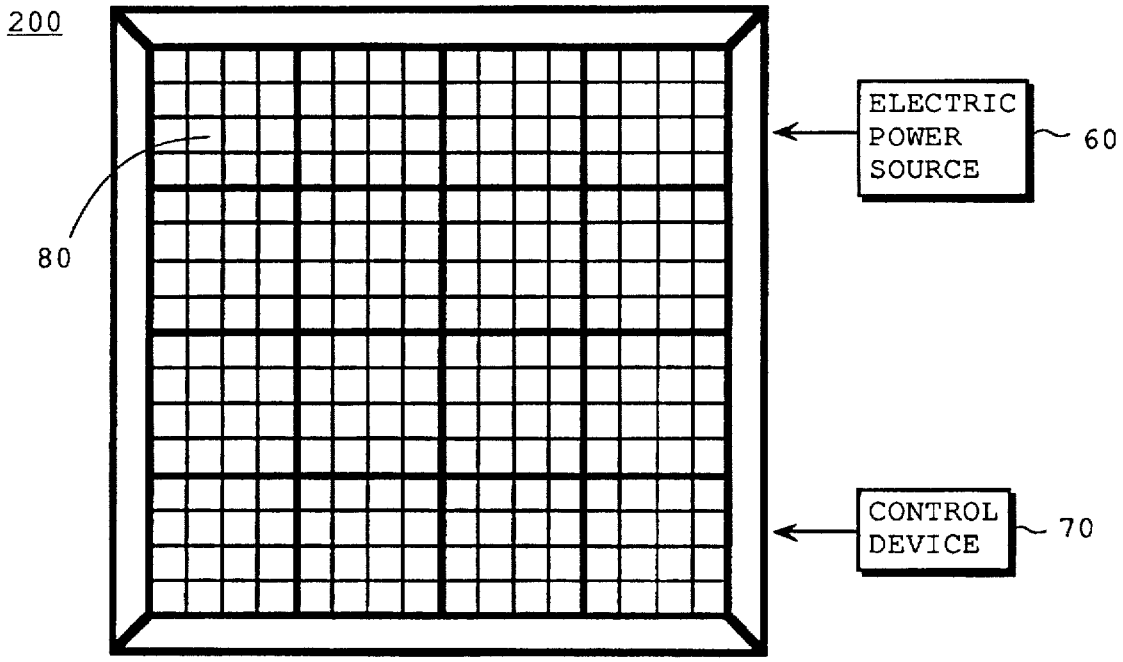
FIG. 11 is a general structural view of the display device according to the second embodiment of the present invention.

FIG. 10 is a partial top view of the display device wherein a plurality of the above-described display unit 80 are accommodated in a casing 200. The casing 200 is constituted of a frame 201 and a bottom plate 202. The frame 201 is a frame in a form of a kind of an architrave. The bottom plate 202 is fixed to the bottom surface of the frame 201. As shown in FIG. 10, the display units 80 are fit in the inside of the frame 201 and supported on the bottom plate 202 with the top surfaces of the display units 80 being flush with the top surfaces of the frame 201. FIG. 11 is a general view of the display device wherein sixteen display units 80 are fit in the device casing 200 with a 4-by-4 matrix arrangement. An electric power source 60 and control device 70 are further included, and the display device according to the present invention is fabricated. In short, this wall display device has such a structure that sixteen tiles (display units 80) are arranged in an architrave (device casing 200). In FIG. 11 the electric power source 60 and the control device 70 are shown in separate blocks, but actually it is preferred that the electric power source 60 and the control device 70 are buried in the device casing 200 as an integral structure.

As described above with reference to FIG. 5, sixteen pixels of 4-by-4 are defined on the pixel panel 82 of each display unit 80, and the light-emitting diodes of three colors 83R, 83G, 83B are buried in respective pixel positions. Accordingly 256 pixels are defined on a display screen of the display device of FIG. 11, and the respective pixels can be illuminated in three primary colors R, G, B.

As seen in FIG. 10, the respective electrodes of each display unit 80 are physically contact with electrodes of its adjacent ones at their corresponding positions. Address electrodes 203A, data electrodes 203D and power electrodes 203P are provided also inside the frame 201 as well as on the side surfaces of the display units 80. These electrodes of the frame 201 are in contact with the address electrodes 84A, the data electrodes 84D and the power electrodes 84P of the display units 80 adjacent to the frame 201. Accordingly, eight address lines 72 and three data lines 73 are wired through four display units in one horizontal row in FIG. 10, and two power source lines 62 are wired through four display units 80 in one vertical column. The address electrodes 203A, the data electrodes 203D and the power electrodes 203P provided at plural positions of the inside of the frame 201 are associated with each other so that the address line 72, the data lines 73 and the power source lines 62 become common for the sixteen display units 80.

Thus, in the second embodiment, the required electrodes are provided on the side surfaces of the respective display units 80, whereby the display units 80 are simply fit into the casing 200 to inevitably form the required wiring. This much simplifies the manufacturing process. For maintenance, the respective display units 80 can be removed for operational test. Therefore the maintenance work becomes very simple.

Then, the operation of this display device will be explained. In the display device according to the present embodiment, as shown in FIG. 11, a total of 256 pixels are provided, and the respective pixels are controlled to emit three primary colors R, G, B. A display signal generated by the control device 70 includes address information indicative of a specific pixel, and data information indicative of a specific display mode for the specific pixel. For example, when the control device 70 generates a display signal "address information: the 123-rd pixel, data information: R;On, G;Off, B;On" and is supplied to the respective display units 80 through the address lines 72 and the data lines 73, the light-emitting diodes 83R and 83B of the 123-rd pixel of the 256 pixels are lit on, and the light-emitting diode 83G is not lit on. In the present embodiment, the light-emitting diodes are controlled so as to take either of the two states of light on and light off, but it is possible to supply luminance signals to the respective light-emitting diodes and control current supply by the regulators so that the light-emitting diodes emit light of luminances corresponding to the luminance signals.

Figure 12:
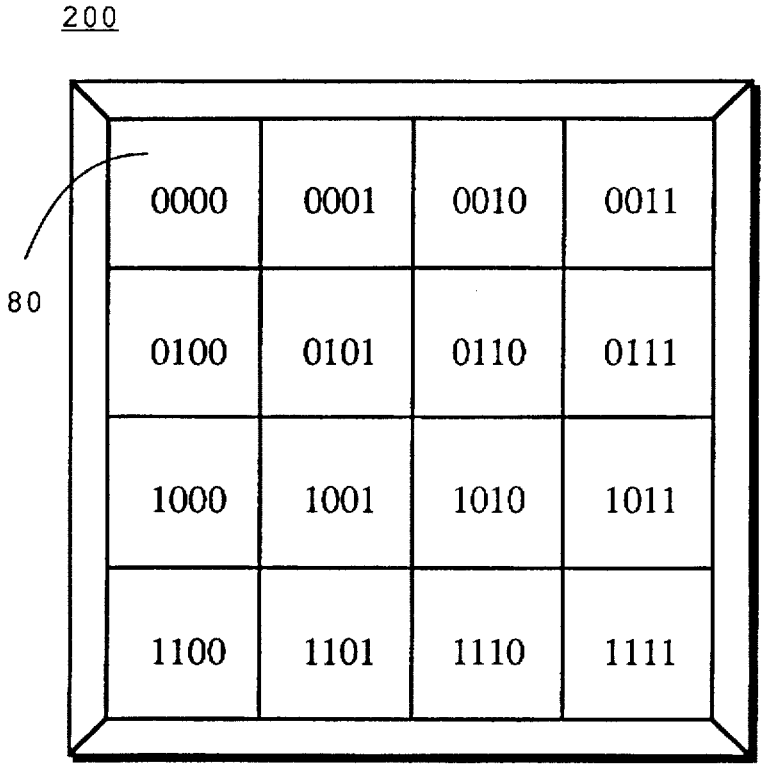
FIG. 12 is an address table showing an example of an address assignment to the sixteen display units 80 constituting the display device shown in FIG. 11.
Figure 13:
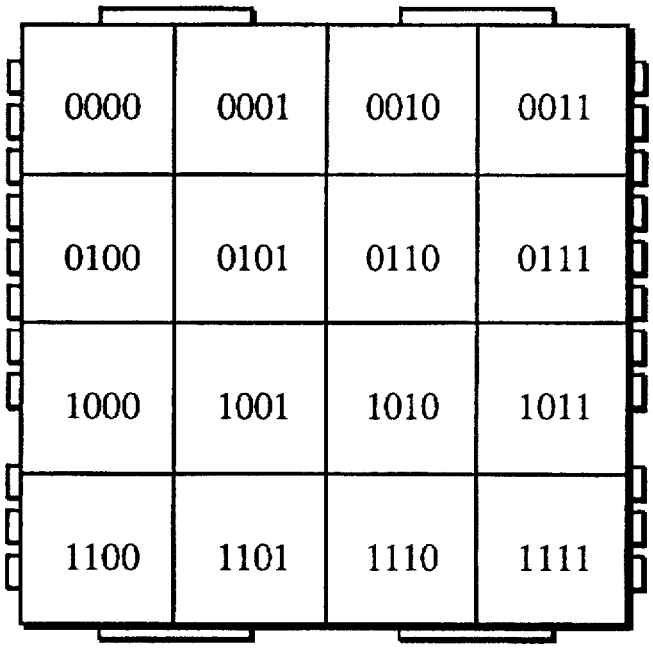
FIG. 13 is an address table showing an example of an address assignment to the sixteen pixels constituting the display unit 80 shown in FIG. 5.

In order to carry out the above-described operation, an 8-bit address is given to each pixel. The upper 4-bit address is information indicative of a specific display unit 80, and the lower 4-bit address is information indicative of a specific pixel belonging to one display unit. An example of thus defining addresses is shown in FIGS. 12 and 13. FIG. 12 shows an address assignment where 4-bit addresses (upper 4-bit addresses) are assigned to the respective sixteen display units 80 accommodated in the casing 200. FIG. 13 shows a an address assignment where 4-bit addresses (lower 4-bit addresses) are assigned to the sixteen pixels of the respective display units 80. By such an address assignment, all the 256 pixels of FIG. 11 can be addressed by 8-bit addresses. For example, the upper left pixel can be addressed by "00000000", and the upper right pixel can be addressed by "00110011".

As shown in FIG. 9, an nonvolatile memory 87 is provided in each display unit 80. In this nonvolatile memory 87 an upper 4-bit address corresponding to a layout position of the display unit 80 in the casing 200 is stored. For example, in the nonvolatile memory 87 in the upper left one of the sixteen display units 80 of FIG. 11, the 4-bit address "0000" is stored with reference to the address assignment of FIG. 12. The work for storing the address is conducted in the manufacturing process of this display device. In this process, the respective display units 80 are accessed one by one by a special writing device, and prescribed address values are stored. To be specific, when a prescribed write instruction is given to the writing device, a writing voltage is applied to the write enable electrode 84W. In a case that the nonvolatile memory 87 is an EEPROM, the writing voltage is set a particular voltage (e.g., 15 V) higher than a normal operational voltage (e.g., 5 V). The writing voltage applied to the write enable electrode 84W is lowered by the resistance element 88 and is supplied to a control terminal of the controller 86 as a write instruction signal. When the write instruction signal is supplied to the controller 86, an address value of the upper 4 bits on the address lines 72 is stored into the memory 87. Thus, when the writing voltage is applied to the write electrode 84W and, simultaneously therewith, a prescribed address value is given to the upper 4 bits of the address lines 72, the address value can be stored in the nonvolatile memory 87.

The process for assembling the display device are as follows to be more specific. First, the casing 200 and sixteen display units are prepared. At this stage, all the display units 80 are completely the same hardware. Then, by the use of the writing device, address values different from one another, i.e., "0000" to "1111" are stored respectively in the sixteen nonvolatile memories 87. Then, the respective display units 80 are fit into the casing 200 in accordance with the address assignment of FIG. 12. No complicated writing is necessary, which makes the assembly very simple.

The controller 86 has a function of writing prescribed address values in the nonvolatile memories 87, but this function is an extra function for assisting the assembly of this display device and is not necessary (in a case that the controller 86 does not have the function of writing, it is necessary to provide, in the writing device, means for executing the direct write in the nonvolatile memories 87). In a practical use of this device as a display device after having been assembled, the controller 86 carries out its intended main function. That is, based on information on the address lines 72 and the data lines 73, and the 4-bit addresses stored in the nonvolatile memories 87, the respective regulators 85 are controlled by the controller 86. This main function of the controller 86 will be explained hereunder.

First, the controller 86 divides an 8-bit address supplied from the eight address lines into an upper 4-bit address and a lower 4-bit address, and recognizes them. Then the controller 86 compares the 4-bit address stored in the nonvolatile memory 87 with the upper 4-bit address supplied from the address lines 72, and executes the following processing only when both agree with each other. That is, a pixel to be accessed is determined, based on the lower 4-bit address supplied from the address lines 72 and with reference to the address assignment of FIG. 13. For example, when the lower 4-bit address is "0001", as shown in FIG. .13, the second pixel from the left in the first row is determined as a pixel to be accessed. Then, based on 3-bit data supplied from the data lines 73, the three regulators 85 associated with the pixel to be accessed are controlled. The three bits of the data supplied from the data lines 73 correspond to the primary colors R, G, B. When a bit is "1", the regulator associated with the primary color corresponding to the bit is energized and is not energized when the bit is "0".

According to the above-described function of the controller 86, required digital information is supplied to the address lines 72 and the data lines 73, whereby the three light-emitting diodes 83R, 83G, 83B of a specific pixel in a specific display unit 80 can be freely controlled to light on/off. To give particular instructions to all the 256 pixels, 256 display signals each containing 8-bit address information and 3-bit data information are prepared and time-divided to be sequentially supplied.

As described above, the respective display units 80 are completely the same hardware, and can be mass-produced. The controller 86 and the nonvolatile memory 87 are constituted of a EEPROM and a CPU having clock generator. Therefore, they can be provided as a single chip device and a structure thereof can become very simple. The light-emitting diodes 83R, 83G, 83B can be formed as diffused regions on a semiconductor substrate, and the regulator 85 can be formed as transistors on the semiconductor substrate. Thus, all the elements shown in FIG. 9 are formed on a single semiconductor wafer by planar process, whereby the display units 80 can be down-sized as a whole, and can have a structure suitable for mass-production. The manufacturing cost can be drastically reduced.

§3. Embodiment having Address Setting Function

In the display device according to the present invention, it is necessary to provide a memory in each display unit and to set unique address information of each display unit in the associated memory. This enables the display units which are completely the same hardware to have operations different from each other, based on their unique address information set in the associated memories. Here an embodiment having a function which can simplify the work for writing respective unique address information, i.e., setting of addresses will be explained.

Figure 14:
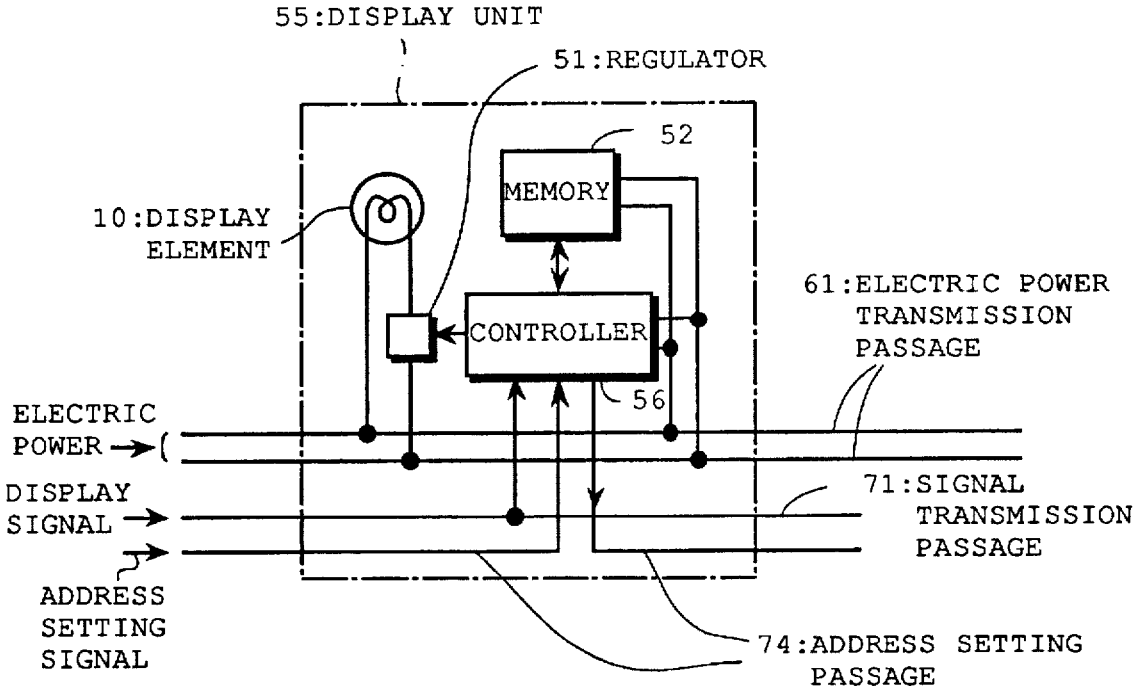
FIG. 14 is a circuit diagram of a display unit 55 constituting an electric bulletin board with an address setting function.

First, an example of the first embodiment described in §1 with addition of an address setting function will be explained. FIG. 14 is a circuit diagram of a display unit 55 constituting an electric bulletin board with an address setting function. Differences of the display unit 55 from the display unit 50 of FIG. 3 are that an address setting passage 74 is provided in addition to the electric power transmission passage 61 and a signal transmission passage 71, and that a controller 56 is used in place of the controller 53. The controller 56 has input terminals of two systems and an output terminal of one system. Display signals are supplied to a first one of the input terminals from the signal transmission passage 71, and address setting signals are supplied to a second one of the input terminals from the address setting passage 74. Address setting signals are outputted from the output terminal to the address setting passage 74.

The operation of the controller 56 at the time that a display signal is supplied from the signal transmission passage 71 is completely the same as that of the controller 53 in the first embodiment. That is, when address information indicative of a specific display unit 55 and data information indicative of an On/Off state thereof as a display signal are supplied to the controller 56, the controller 56 operates to give an On/Off instruction to the regulator 51 only when the address information in the transmitted display signal corresponds to the address information stored in the nonvolatile memory 52.

Figure 15:
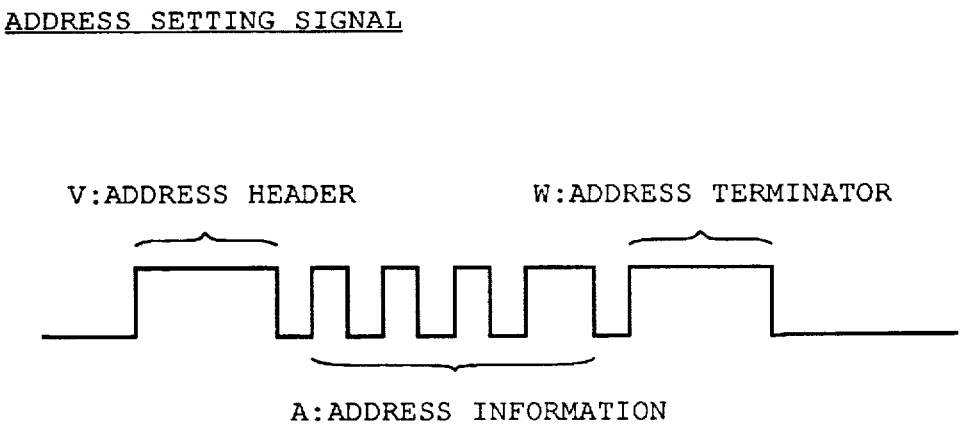
FIG. 15 is a signal diagram showing an example of an address setting signal supplied to the display unit 55 shown in FIG. 14.

On the other hand, when an address setting signal is supplied from the address setting passage 74 to the controller 56, the controller 56 carries out a writing procedure to write a specific address value indicated by the address setting signal. The address setting signal has a format exemplified in FIG. 15. The address setting signal shown in FIG. 15 is a digital signal having a binary state of high and low levels. The address header V indicates that address information A will follow. The address terminator W indicates that the address setting signal ends. In the present embodiment the address information A is digital information of 8 bits and indicates "address 1" to "address 50".

When the controller 56 receives an address setting signal exemplified in FIG. 15, the controller 56 writes an address value of the address information A included in the address setting signal as it is into the nonvolatile memory 52 (a required writing voltage is simultaneously supplied in a case that the nonvolatile memory 52 is provided by an EEPROM). Subsequently the controller 56 increments the address value by "1" and outputs the increased address value to the address setting passage 74 through it's output terminal. In other words, address information A on the address setting passage 74 on an input side of a particular controller 56 differs from that on an output side of the same particular controller 56 (a larger address value by "1" is obtained on the output side). The controller 56 has such a processing function, whereby address setting can be efficiently conducted in a plurality of the display units 55. Next this address setting operation will be explained in detail.

Figure 16:
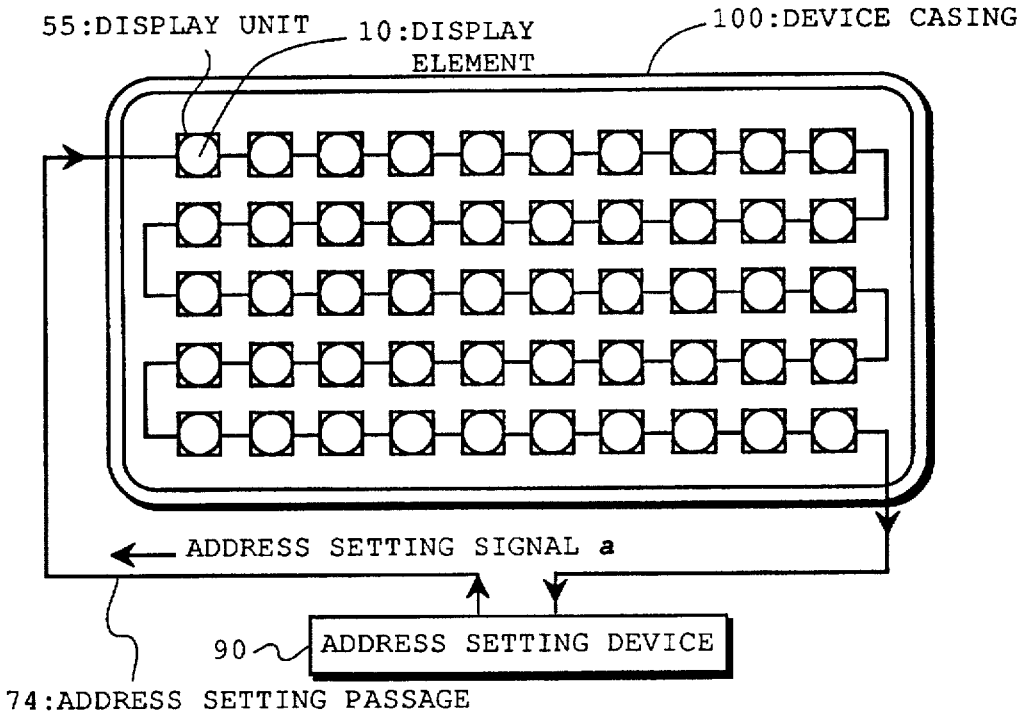
FIG. 16 is a view showing an example of practical wiring for address setting passage 74 in a display device constituted of the display units 55 shown in FIG. 14.

In order to assemble a display device, fifty display units, one of them being shown in FIG. 14, are prepared and arranged adjacent to each other in a device casing 100 in a 5-by-10 matrix as shown in FIG. 16. The address setting passage 74 interconnects the respective fifty display units 55 and the address setting device 90. That is, the fifty display units 55 are serially connected to each other by the address setting passage 74, and an address setting signal a outputted from the address setting device 90 is transmitted through the first display unit 55, the second display unit 55, the third display unit 55, . . . , the forty-ninth display unit 55 and the fiftieth display unit 55 and is finally returned to the address setting device 90. As shown in the circuit diagram of FIG. 14, the address setting passage 74 is wired so as to essentially pass through the respective controllers 56, and this is a difference from the wiring of the signal transmission passage 71. That is, a display signal is supplied to the respective controllers 56 by branch lines divided from a main passage 71, but an address setting signal is transmitted through a main passage inside the respective controllers 56.

Here considering that the controllers 56 have the above-described function, it is understood that, in the display device of FIG. 16, by supplying a required address setting signal a from the address setting device 90, the address setting can be realized in all the fifty display units 55 accommodated in the device casing 100. For example, a signal indicative of "address value 1" is outputted as an address setting signal a from the address setting means 90. Then, in the first display unit 55, the controller 56 writes the "address value 1" in the nonvolatile memory 52. Subsequently the "address value 1" is increased to "address value 2" in the controller 56 and this new address value is outputted to the address setting passage 74. In short, the address setting signal a which has indicated "address value 1" at the node immediately before the first display unit 55 becomes to indicate "address value 2" at the node immediately after the first display unit 55. Then the "address value 2" is transmitted to the second display unit 55 as a new address setting signal a and is stored in the nonvolatile memory 52 of the second display unit 55. Thus the address setting signal a is incremented by "1" every time when it passes through a display unit 55, so that "address value i" is stored in a nonvolatile memory of the i-th display unit 55. When an "address value 51" is finally back to the address setting device 90, it can be confirmed that the address setting has been completed without any trouble.

Thus, when the respective display units 55 shown in FIG. 14 are arranged to assemble the display device and the address setting passage 74 is wired as shown in FIG. 16, the address setting in all the display units 55 can be very efficiently conducted. Though the wiring of only the address setting passage 74 is illustrated in FIG. 16, actually the electric power transmission passage 61 and the signal transmission passage 71 are wired for the respective display units 55 as shown in the circuit diagram of FIG. 2. After the address setting is completed, the display device operates as an electric bulletin board described in §1.

Figure 17:
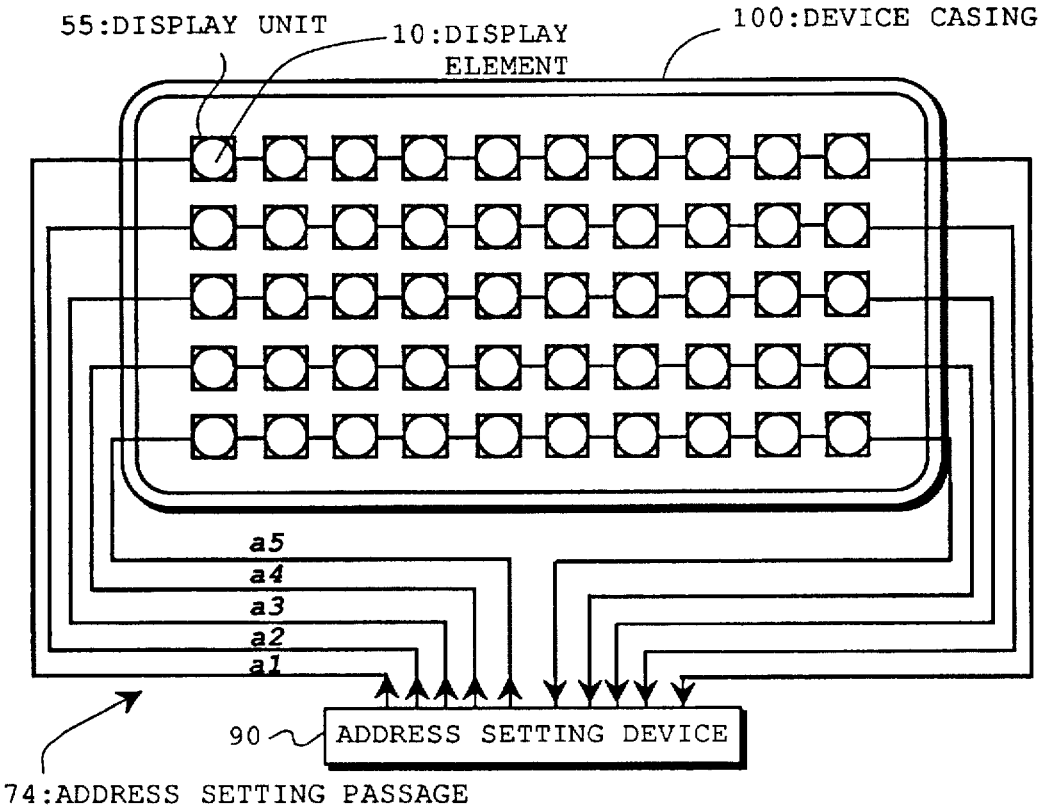
FIG. 17 is a view showing another example of practical wiring for address setting passage 74 in a display device constituted of the display units 55 shown in FIG. 14.

In the circuit diagram of FIG. 16, all the fifty display units are serially connected to each other by the address setting passage 74, but it is possible, as shown in the circuit diagram of FIG. 17, to divide the fifty display unit 55 in some groups, and the display units 55 are serially connected to each other in the respective groups. In the example of FIG. 17, the display units are grouped in five rows, and ten display units 55 in each group are serially connected by an associated address setting passage 74. Five address setting passages 74 are connected to the address setting device 90, and address setting signals of different address values from each other are outputted to the respective address setting passage 74. For example, as five address setting signals a1, a2, a3, a4, a5 in FIG. 17, "address value 1", "address value 11", "address value 21", "address value 31" and "address value 41" are outputted, whereby "address values 1" to "address value 50" can be set in the all of fifty display units 55.

Figure 18:
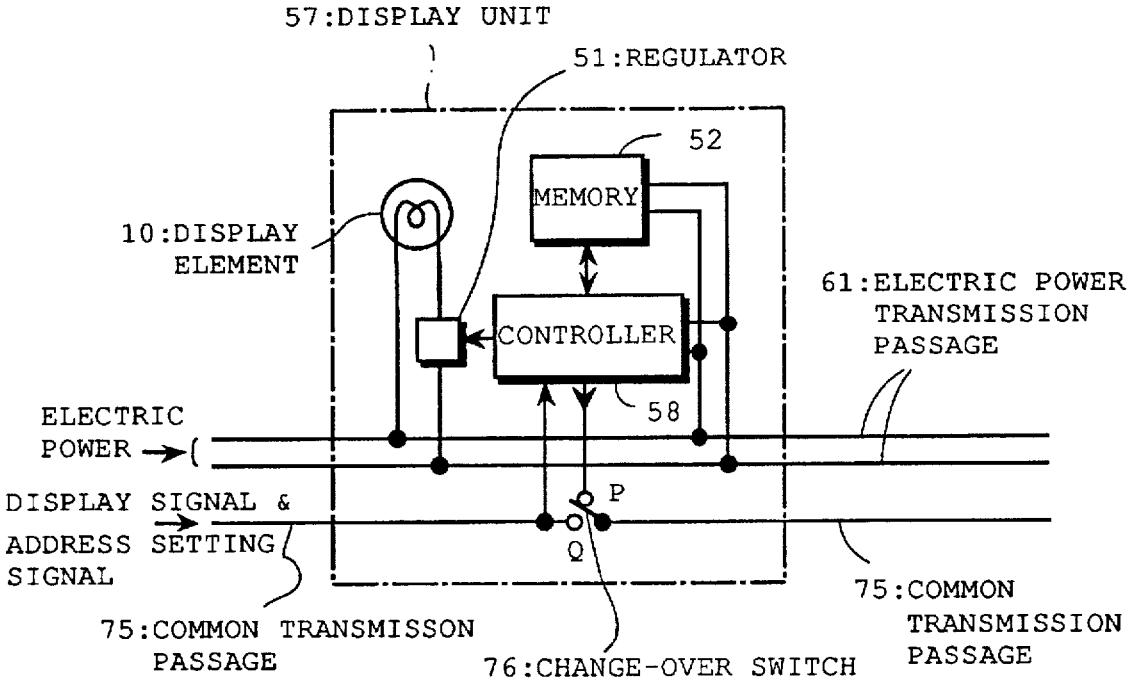
FIG. 18 is a circuit diagram of another display unit 57 constituting an electrical bulletin board with an additional function of address setting.

In the above-described example, the signal transmission passage 71 and the address setting passage 74 are separate from each other to make the address setting efficient. However, it is practically possible to provide a common passage which functions as both a signal transmission passage 71 and an address setting passage 74. A display unit shown in FIG. 18 is one example which is so constituted that the signal transmission passage 71 and the address setting passage 74 are provided by a common transmission passage 75. In other words, in this display unit 57, the common transmission passage 75 has both functions of the signal transmission passage 71 and of the address setting passage 74. Therefore, both a display signal and an address setting signal are transmitted through the common transmission passage 75. The address setting signal is necessary only for the address setting in a preparatory step for using this display device, though the display signal is an operational signal required in an practical operation of the display device. Accordingly it is not necessary to simultaneously use both the signals. Thus it causes no trouble to use the common transmission passage 75 for transmission of both the display signal and the address setting signal.

However, as described above, display signals are supplied to the respective controllers through lines branched from the main passage, but address setting signals must be transmitted through the interiors of the respective controllers. To this end, change-over switches 76 are provided in the respective display units 57. The common transmission passage 75 functions as the address setting passage 74 when the change-over switch 76 is at a contact P, and functions as the signal transmission passage 71 when the change-over switch 76 is at a contact Q.

The controller 56 in FIG. 14 has the two input terminals, which permits the controller 56 to physically recognize whether a supplied signal is a display signal or an address setting signal. Accordingly it is possible to provide two independent routines of program of a normal display routine and an address setting routine for the controller 56 so as to switch the processing. That is, the controller 56 executes the normal display routine when a display signal is supplied to, and executes the address setting routine when an address setting signal is supplied to. However, the controller 58 shown in FIG. 18 has only one input terminal, and therefore the controller 58 cannot physically recognize whether a supplied signal is a display signal or an address setting signal. Then it is necessary to supply to the controller 58 information indicating which of the two routines of the normal display routine and the address setting routine to be executed. For this purpose, it is preferable to prepare some means for recognizing a state of the change-over switch 76 and providing a recognized signal to the controller 58. When the switch 76 is at the contact P, an instruction to execute the address setting routine is given to the controller 58, and when the change-over switch 76 is at the contact Q, an instruction to execute the normal display routine is given to the controller 58.

Otherwise it is possible to instruct, by means of software, the controller 58 based on address values transmitted through the common transmission passage 75 to chose the normal display routine or the address setting routine. For example, in the case that fifty display units 57 are arranged to form an electric bulletin board, address values of only 1 to 50 are used. Therefore, the controller 58 can be programmed so as to jump to the address setting routine only when a special address value, e.g., "address value 99" is supplied from the common transmission passage 57. In this case, in order to set address values 1 to 50 for the respective display units, "address value 99" and then "address value 1" are supplied to the common transmission passage 75. Upon receiving the leading "address value 99", the controller 58 jumps to the address setting routine and executes the address setting, based on the following address value.

Since this address setting routine is conducted in a preparatory step for the display device, the change-over switch 76 can be sufficiently provided by a jumper line or a dip switch. Otherwise, the change-over switch 76 is provided by a semiconductor switch, such as a transistor, whereby the change-over switch 76 can be automatically switched by a control signal from the controller 58. In this case, the change-over switch 76 is normally at the contact Q and is automatically switched to the contact P only upon receiving a special value, such as "address value 99". Thus the change-over switch 76 can be switched, based on digital data supplied to the common transmission passage 75, and a change-over can be completed by means of software.

In a case where the change-over is completely conducted by means of software, it is possible to omit the change-over switch 76. That is, in the circuit diagram of FIG. 18, the change-over switch 76 may be replaced merely by a line always connected to the contact P. In this case, the transmission passage 75 unavoidably passes through the interior of the controller 58, but the controller 58 is programmed so as to output an inputted address value as it is during the normal display routine so that display signals on the transmission passage 75, which are passed through the interior of the controller 58, are not changed. This is an operation equivalent to that conducted with the change-over switch 76 at the contact Q. On the other hand, the controller 58 is so programmed that in a case where a special value, such as "address value 99" is supplied, the address setting routine is conducted only on an address value supplied next, and the increment is conducted. However, in the above-described arrangement, there is a risk that a delay of the display signal may take place between on the first display unit and on the last display unit, because the display signal passes through all the controllers 58 which are serially connected. For the prevention of such a signal delay, the switching by using the change-over switch is preferable.

Figure 19:
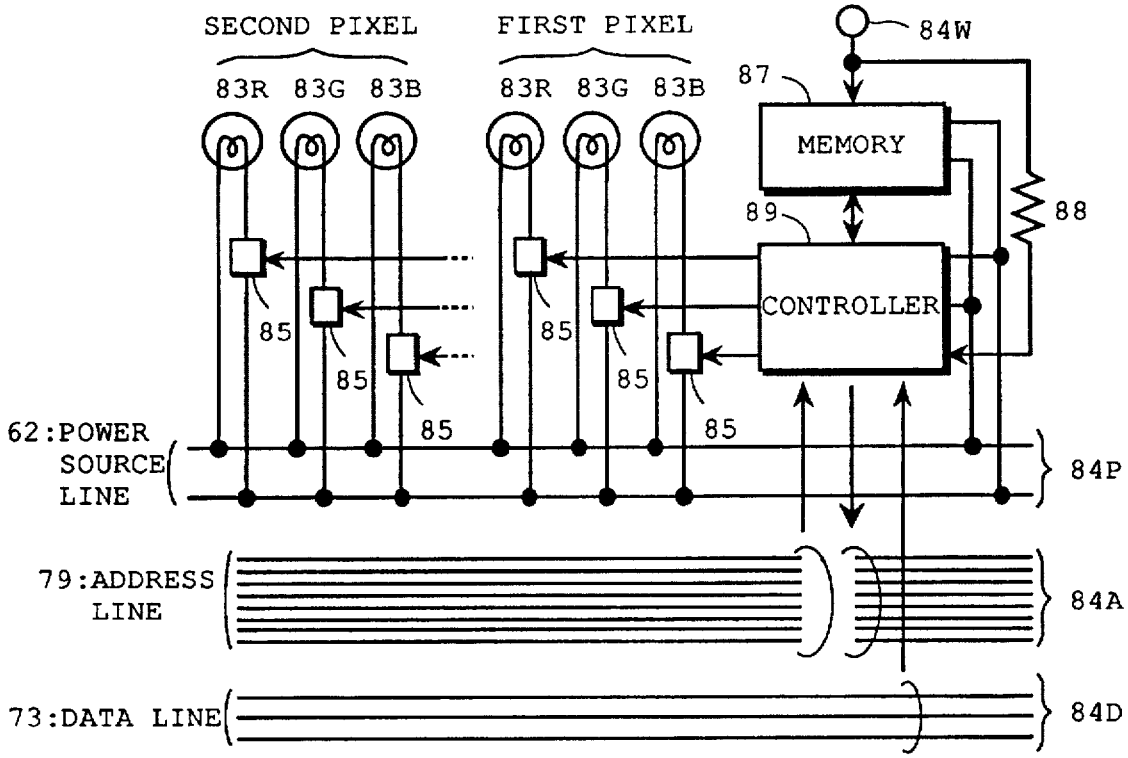
FIG. 19 is a circuit diagram showing a structure that an address setting function is added to the circuit shown in FIG. 9.

Though the above-described embodiment is basically the first embodiment described in §1 with the addition of the address setting function, it is also possible to add the address setting function to the second embodiment described in §2. FIG. 19 shows a circuit diagram of an example of the latter. In this example, the address lines 79 are passed through the controller 89. The controller 89 normally executes a processing equivalent to the normal display processing described in §2. That is, data of 8 bits inputted from an input side of the address lines 79 are outputted as they are to an output side thereof. Accordingly address values on the address lines 79 do not change even after passed through the controller 89. While the controller 89 executes the address setting procedure when a voltage is applied through a resistor 88, in other words, a writing voltage is applied to the write enable electrode 84W. That is, the controller 87 stores the 8-bit data inputted from the input side of the address lines 79 into the nonvolatile memory 87, increases the 8-bit data by 1 and outputs the increased data to the output side of the address lines 79. Accordingly the address value transmitted on the address lines 79 is increased by one when passes through each controller 89.

§4. Other Variations

Thus the present invention has been described by means of the embodiments shown in the drawings, but the present invention is not limited to the above-described embodiments. The present invention covers other embodiments. Especially the display elements are light bulbs in the first embodiment and light-emitting diodes in the second embodiment, but the display elements according to the basic idea of the present invention are not limited to such light-emitting elements. For example, panel-type display elements including, e.g., cubics each having a plurality of display faces may be used so as to rotate them by motors to display specific display faces. In short, the present invention is applicable to any display device as long as the display device includes a plurality of display elements as pixels which can be electrically driven to change a display mode.

In the above-described embodiments, the nonvolatile memories are provided by EEPROMs and the controllers are provided by CPUs. The nonvolatile memories may be any memories as far as which can retain stored contents even after the electric power source is shut off. The controllers may be constituted of wired logic circuits or transistor circuits as long as they have the above-described function. The nonvolatile memories are not essentially the so-called semiconductor memories and may be devices, such as DIP switches, which can mechanically store information.

In the above-described embodiment, the electric power transmission passage 61 and the signal transmission passage 71 are provided by respectively independent wiring lines, but it is possible to provide them by a physically same wiring line which functions as a multi-transmission passage to transmit electric power and display signals. Further, the way for transmitting electric power and display signals to the respective display units are not limited to using conductive wiring lines, and it is possible to supply electric power and display signals by magnetic coupling. It is also possible to supply display signals to the respective display units by the use of wireless means or light (e.g., infrared rays). In a case that light is used, optical connectors are provided on the side surfaces of the display units 80 in place of the electrodes 84A, 84D, 84P.

In the embodiment with the address setting function described in §3, an address value is increased by 1 by the controllers 56, 58, 89, but it is possible to decrease an address value by 1. Unless continuous address setting is necessary, an increment value or a decrement value is not essentially "1". In short, what is necessary is that an address value is passed through the controllers to be renewed, whereby unique addresses are set in the respective display units.

As described above, according to the present invention, the display device is constituted of a plurality of display units, and the respective units have the address recognizing function, whereby the respective display units can be wired by a common electric power passage and a common signal transmission passage. Thus the wiring of the respective display units is simplified, and the manufacturing process and maintenance can be facilitated.

Industrial Applicability

The display device according to the present invention is applicable to electric bulletin boards and large display devices including a number of rows of light bulbs, light-emitting diodes or rotary panels.

I claim:

1. A display device having an array of display elements to display information, each of said display elements having a function to electrically change display modes of a pixel, said display device comprising:

a plurality of display units, each of said display units including a display element, a regulator for controlling supply of electric power to the display element, memory means for storing prescribed address information, and a controller for controlling the regulator based on the address information stored in the memory means and a display signal supplied from outside the display units;

a casing for fixedly accommodating said display units with the display elements arranged adjacent to each other on a display screen;

an electric power source for generating electric power for driving the display elements;

a control device for generating said display signal indicating a display mode of the display elements;

electric power transmission means for supplying the electric power generated by the electric power source to the regulators in the respective display units accommodated in the casing;

signal transmission means for supplying the display signal generated by the control device to the controllers in the respective display units;

wherein respective unique address information is stored in the respective memory means of the display units and the display signal contains address information for indicating a specific display unit and data information for indicating a specific display mode;

wherein the controller controls the regulator based on the data information in the display signal when the address information stored in the memory means corresponds to the address information contained in the display signal;

wherein a plurality of display elements are provided in each display unit;

wherein the address information contained in the display signal includes first address information indicative of a specific display unit and second address information indicative of a specific display element in a display unit; and wherein the controller controls a regulator for a specific display element indicated by the second address information based on the data information in the display signal when the address information stored in the memory means corresponds to the first address information.

2. A display device according to claim 1:

wherein each display element includes a first color presenting element for presenting a first primary color R by energizing, a second color presenting element for presenting a second primary color G by energizing, and a third color presenting element for presenting a third primary color B by energizing;

wherein the data information in the display signal includes information instructing light emitting states of the respective color presenting elements; and wherein the controller controls the regulator to supply electric power in accordance with said instructing information.

3. A display device according to claim 1:

wherein each display unit includes a container;

wherein a display surface is formed by the display element on a top surface of the container, and electrodes functioning as a part of the electric power transmission means and the signal transmission means are formed on side surfaces of the container; and wherein a plurality of display units are accommodated in the casing so that electrodes formed on the display units are physically in contact with adjacent ones, transmission lines of the electric power transmission means and the signal transmission means being constituted by physical contact between the electrodes.

4. A display device according to claim 1, further comprising:

an address setting line for serially connecting a plurality of controllers in all or a part of the display units;

wherein the respective controller has a function of address setting in which when prescribed address information is supplied to an input side of the address setting line, the address information is stored in the memory means, and the address information is renewed and outputted to an output side of the address setting line.

5. A display device having an array of display elements to display information, each of said display elements having a function to electrically change display modes of a pixel, said display device comprising:

a plurality of display units, each of said display units including a display element, a regulator for controlling supply of electric power to the display element, memory means for storing prescribed address information, and a controller for controlling the regulator based on the address information stored in the memory means and a display signal supplied from outside the display units;

a casing for fixedly accommodating said display units with the display elements arranged adjacent to each other on a display screen;

an electric power source for generating electric power for driving the display elements;

a control device for generating said display signal indicating a display mode of the display elements;

electric power transmission means for supplying the electric power generated by the electric power source to the regulators in the respective display units accommodated in the casing; and signal transmission means for supplying the display signal generated by the control device to the controllers in the respective display units;

wherein respective unique address information is stored in the respective memory means of the display units and the display signal contains address information for indicating a specific display unit and data information for indicating a specific display mode;

wherein the controller controls the regulator based on the data information in the display signal when the address information stored in the memory means corresponds to the address information contained in the display signal;

an address setting line for serially connecting a plurality of controllers in all or a part of the display units;

wherein the respective controller has a function of address setting in which when prescribed address information is supplied to an input side of the address setting line, the address information is stored in the memory means, and the address information is renewed and outputted to an output side of the address setting line.

6. A display device according to claim 5, further comprising a common transmission line which functions as both the signal transmission means and the address setting line; and wherein the common transmission line is switched so that when the common transmission line functions as the signal transmission means, branches of the common transmission line connect to the respective controllers, and when the common transmission line functions s the address setting line, the common transmission line provides a serial connecting line to serially connect the respective controllers.

* * * * *